US006149152A

United States Patent [19]

Mancke

[11] Patent Number: 6,149,152

[45] Date of Patent: Nov. 21, 2000

[54] APPARATUS FOR FACILITATING THE TEACHING AND PRACTICE OF SOCCER RELATED SKILLS

[76] Inventor: Patrick Mancke, 305 Penn Oak Rd., Flourtown, Pa. 19031

[21] Appl. No.: 09/422,157

[22] Filed: Oct. 22, 1999

[51] Int. Cl.[7] ..... A63F 7/00

[52] U.S. Cl. ..... 273/123 R; 434/251

[58] Field of Search ..... 434/247, 251; 223/317.2, 348, 393, 108.2, 123 R

[56] References Cited

U.S. PATENT DOCUMENTS

| | | | |
|---|---|---|---|
| 406,342 | 7/1889 | Dumont . | |
| 607,020 | 7/1898 | Dodge | 273/123 R |
| 1,136,153 | 4/1915 | Martineau | 273/123 R |
| 1,176,274 | 3/1916 | Clark | 273/123 R |
| 1,503,415 | 7/1924 | Fohmann | 273/123 R |
| 2,067,732 | 1/1937 | Rimmer | 272/95 |
| 2,077,343 | 4/1937 | Oakes et al. | 272/1 |
| 2,326,859 | 8/1943 | Hoover | 273/123 R |
| 2,449,708 | 9/1948 | Lindsay | 273/127 |
| 2,753,187 | 7/1956 | Orsini | 273/123 R |
| 3,163,417 | 12/1964 | Capouscio | 273/317.2 |
| 3,709,489 | 1/1973 | Holleran et al. | 273/1 B |
| 3,790,174 | 2/1974 | Skillern | 273/105 A |
| 3,809,404 | 5/1974 | Fikse | 273/317.2 |
| 3,979,120 | 9/1976 | Dietrich | 273/127 B |
| 4,019,739 | 4/1977 | Waite | 273/123 R |
| 4,492,380 | 1/1985 | Saytar | 273/411 |
| 4,619,456 | 10/1986 | Meggs | 273/127 B |
| 4,721,306 | 1/1988 | Shewchuk | 273/127 B |
| 5,553,863 | 9/1996 | Wynne | 273/402 |
| 5,746,669 | 5/1998 | Sinsheimer et al. | 473/446 |

*Primary Examiner*—Sam Rimell
*Attorney, Agent, or Firm*—LaMorte & Associates, P.C.

[57] ABSTRACT

An apparatus used to teach and practice soccer related skills. The soccer training apparatus includes an inclined target board that has at least one aperture that is large enough to receive a soccer ball. An inclined plane is positioned in front of the inclined target board. The inclined plane can either be in the same plane as the target board or can terminate above the bottom of the target board to form a ramp. The target board is supported in place by a frame structure. Different netted targets are formed within the frame structure. The various netted targets enable players to practice different types of kicking skills. The frame structure also supports a tethered ball and practice goals that are also used in various soccer practice drills.

17 Claims, 4 Drawing Sheets

APPARATUS FOR FACILITATING THE TEACHING AND PRACTICE OF SOCCER RELATED SKILLS

BACKGROUND OF THE INVENTION

1. Field of the Invention

In general, the present invention relates to practice devices that are used to help people train for the sport of soccer. More particularly, the present invention relates to practice devices that contain multiple stations so that different skills can be practiced at each of the stations.

2. Description of the Prior Art

Soccer is perhaps the most popular sport in the world. The sport is played by millions of people worldwide and is particularly popular among school aged children. Given the wide popularity of soccer, it will be understood that the prior art record is replete with training aids and devices that are intended to assist a person in developing the skills needed to play soccer well.

To play soccer well, a player must develop a variety of different skills. Among those skills are the abilities to kick the soccer ball accurately, pass the soccer ball accurately, control the soccer ball while running and striking the soccer ball with your head. In the prior art, practice devices tend to be dedicated to developing single skills. For example, many prior art practice devices utilize obstacle courses through which a player must learn to kick the soccer ball. Such training devices help a player develop good foot control of a soccer ball. Other prior art training devices include obstructions that are placed in front of a soccer goal. The obstructions help a player develop accurate shooting skills.

Soccer coaches are responsible for teaching players all of the skills needed to play soccer competitively. However, soccer coaches often do not have the finances or facilities to purchase all the different pieces of training equipment needed to properly train their players. This is especially true for community child's soccer programs where there is very little financing available and the coaches are commonly volunteering parents of the players.

A need therefore exists for a soccer training system that is low cost, light weight, easily transported and capable of training players in multiple different skills. Such a training system eliminates the need for multiple different pieces of training equipment and provides quality training facilities to every level of player. This need is met by the present invention as described and claimed below.

SUMMARY OF THE INVENTION

The present invention is an apparatus used to teach and practice soccer related skills. The soccer training apparatus includes an inclined target board that has at least one aperture that is large enough to receive a soccer ball. An inclined plane is positioned in front of the inclined target board. The inclined plane can either be in the same plane as the target board or can terminate above the bottom of the target board to form a ramp.

The target board is supported in place by a frame structure. Different netted targets are formed within the frame structure. The various netted targets enable players to practice different types of kicking skills. The frame structure also supports a tethered ball and practice goals that are also used in various soccer practice drills.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
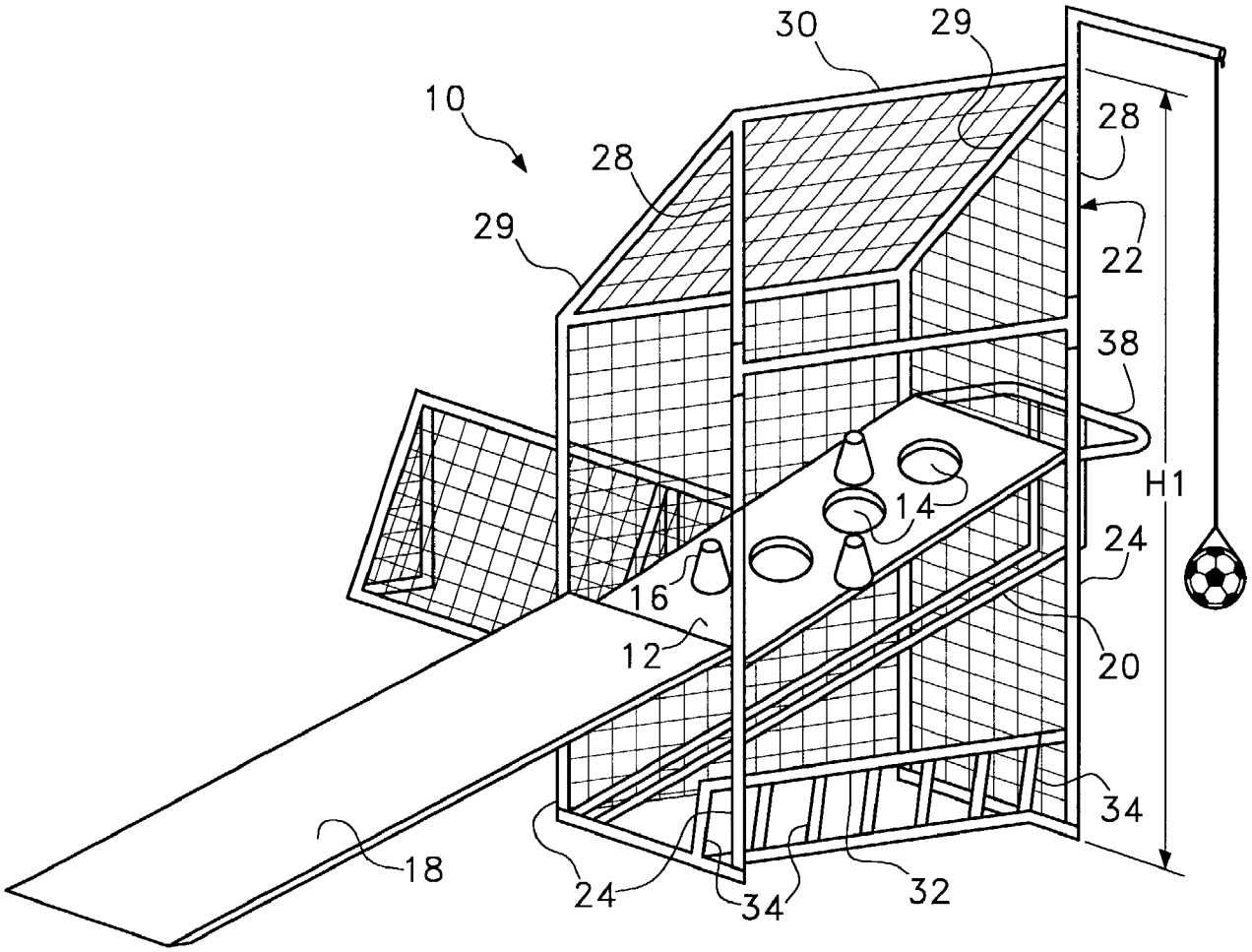
FIG. 1 is a perspective of an exemplary embodiment of a soccer training apparatus in accordance with the present invention.

Referring to FIG. 1, an embodiment of a soccer training apparatus 10 is shown in accordance with the present invention. The soccer training apparatus 10 has multiple features, each of which are intended to teach and aid in the practice of the skills needed to play soccer well. Each of the multiple features will be individually described.

Figure 2:
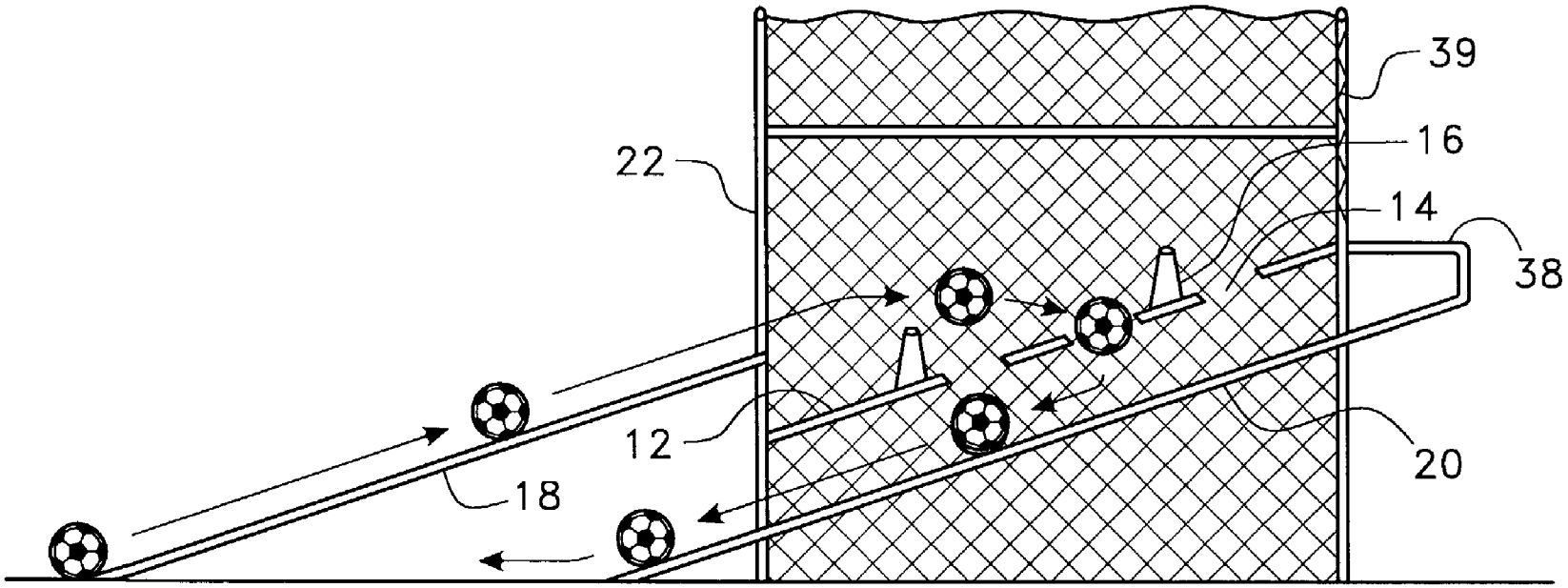
FIG. 2 is a cross-sectional view of the embodiment of the soccer training apparatus shown in FIG. 1.

Among the many features of the soccer training apparatus 10 is an inclined target board 12. Referring to FIG. 2 in conjunction with FIG. 3, it can be seen that the inclined target board 12 contains a plurality of target apertures 14 through it's structure. The target apertures 14 are large enough to enable a soccer ball to pass through the inclined target board 12. Obstacles 16 may be located on the top surface of the inclined target board 12. The location, size and number of the obstacles 16 can be altered depending upon the skill of the soccer player utilizing the soccer training apparatus 10.

Positioned in front of the inclined target board 12 is a ramp 18. A player places a soccer ball at the bottom of the ramp 18 or on the ground in front of the ramp 18. The player then kicks the ball up the ramp 18 and on to the inclined target board 12. It takes great kicking coordination and finesse to kick the soccer ball so that it passes into one of the target apertures 14 on the inclined target board 12. As such, the kicking of the soccer ball up the ramp 18 and onto the inclined target board 12 teaches a player how to precisely control the movement of the soccer ball when kicking the soccer ball. Such skills are necessary in playing soccer when passing the soccer ball and shooting the soccer ball. The degree of difficulty in a player's practice can be increased or decreased by adding and subtracting obstacles 16 from the inclined target board 12. The degree of difficulty should be set so that it challenges the player to kick the soccer ball into a target aperture 14 without relying purely upon blind luck.

If desired sensors can be placed in the various target apertures 14 of the target board 12 that sense when a soccer ball has passed through one of the target apertures 14. The sensors can be attached to an electronic scoreboard (not shown) that would keep score of successful kicks. The scoreboard adds fun to the kicking drill and promotes competition between players.

A guide track 20 is disposed below the target apertures 14 on the inclined target board 12. The guide track 20 receives any ball passing through one of the target apertures 14 and guides that ball back to a predetermined point near the front of the inclined target board 18.

Netting is disposed around the inclined target board to prevent a soccer ball from bouncing away from the soccer training apparatus 10 after it is kicked up the ramp 18. The netting is supported by a frame structure 22. Referring solely to FIG. 1, it can be seen that four vertical posts 24 are positioned around the inclined target board 12 near the corners of the inclined target board 12. Cross posts 26 extend horizontally across the vertical posts 24 parallel to the long sides of the inclined target board 12. The areas extending from the cross posts 26 to the top surface of the inclined target board 12 are covered with netting.

A secondary netting frame is mounted atop the four vertical posts 24 that surround the target board 12. The secondary netting frame is comprised of two vertical posts 28 and two slanted posts 29. The vertical posts 28 mount directly atop of the two forward vertical posts 24 of the frame structure 22. The two vertical posts 28 are joined by a cross post 30. The combined height H1 of the secondary netting frame vertical posts 28 atop the target board vertical posts is equal to the regulation height of a soccer goal. Netting is mounted to the sides and rear of the secondary netting frame. However, the area defined between the cross post 26 of the target board frame and the cross post 30 of the secondary netting frame is open.

The purpose of the secondary netting frame is to provide a high target for practice. The secondary netting frame defines an area of netting that is the same height and size as the corner of a regulation goal. Accordingly, a player can practice top corner goal kicks by kicking balls into the area of the secondary netting frame. Any soccer ball kicked into the area of the secondary netting frame falls onto the inclined target board 12. If the soccer ball passes through a target aperture 14 on the inclined target board 12, the ball is received by below lying ball guide track 20.

A low cross post 32 also extends across the front vertical posts 24 of the target board frame. The low cross post 32 is positioned between one foot and three feet above the ground. A series of slanted rear posts 34 extend from the cross post 32, defining a small goal area. The purpose of the small goal area is to provide a random return target for practice. When a players kicks a soccer ball into the small goal area, the soccer ball hits one of the slanted rear posts and rebounds out of the small goal area. The direction of the rebound is dependent upon how the soccer ball strikes the slanted rear posts 34. Accordingly, a player will not be able to anticipate the direction of the soccer ball as it rebounds from the small goal area. This enables players to practice the skill of fielding unanticipated passes during soccer play. Furthermore, the small goal area also simulates the lower corner of a regulation goal. Accordingly, a player can practice low corner goal kicks by kicking balls into the small goal area.

Referring back to FIG. 1, in conjunction with FIG. 2, it can be seen that a hoop structure 38 extends rearwardly from the target board frame structure 22. The ball return guide track 20 that passes under the inclined target board 12 also extends under the hoop structure 38. Consequently, any soccer ball that passes through the hoop structure 38 is received by the ball return guide track 20 and returned to the front of the target board frame.

The netting 39 (FIG. 2) positioned above the hoop structure 38 is taut. As such, the netting 39 above the hoop structure 38 acts as a backboard and a small target. The combined hoop structure 38 and backboard netting 39 provides a target for a player to practice accurate, controlled passing. If a player kicks the ball to the backboard netting 39 inaccurately, the soccer ball will not fall through the hoop structure 38. If a player accurately kicks a ball to the backboard netting, but does so too hard, the soccer ball will bounce off the backboard netting 39 away from the hoop structure 38.

Figure 3:
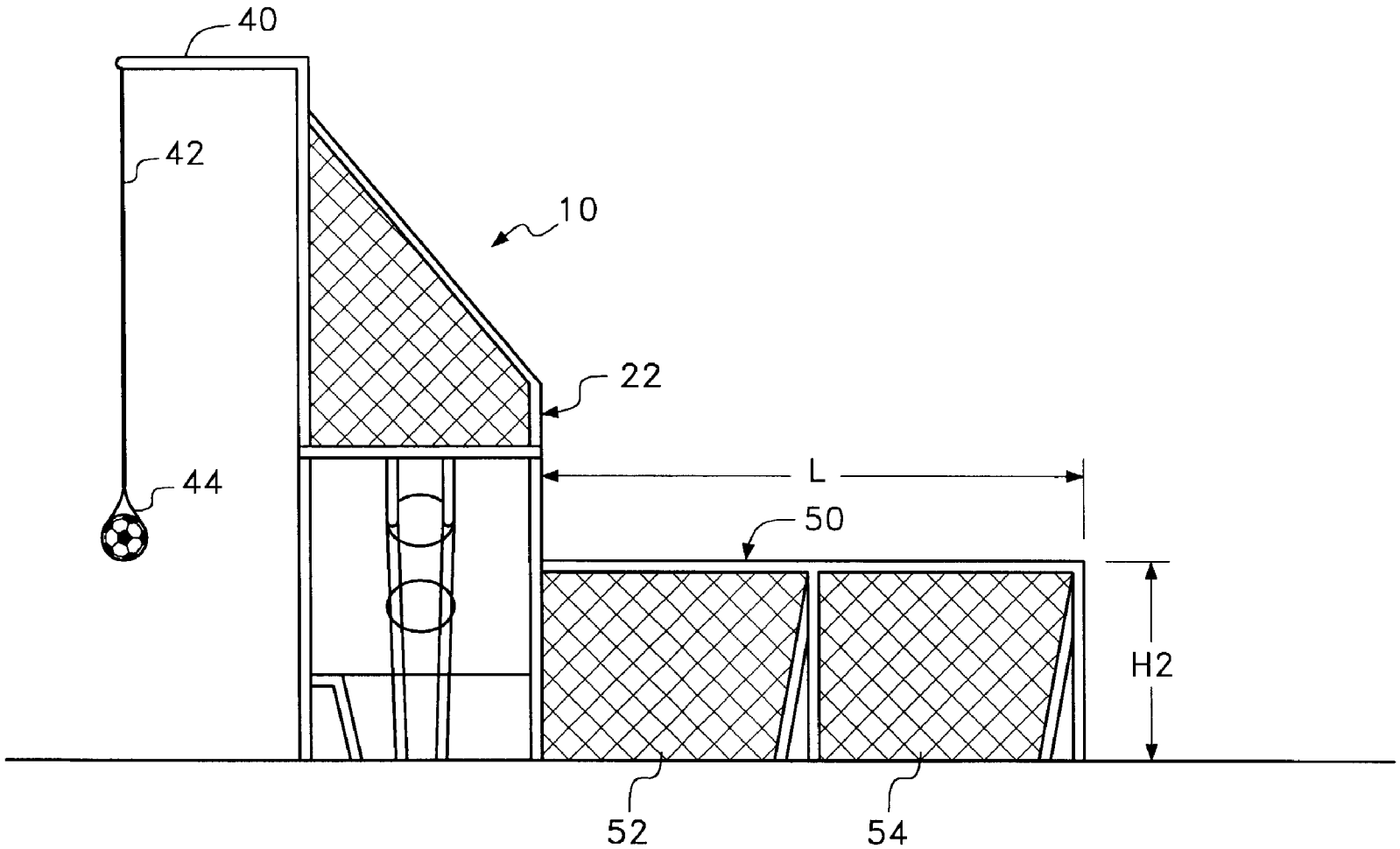
FIG. 3 is a rear view of the embodiment of the soccer training apparatus shown in FIG. 1.

Referring to FIG. 3, it can be seen that a vertical arm 40 extends from the top of the soccer training apparatus 10. A tether 42 extends downwardly from the vertical arm 40. The end of the tether 42 terminates in a mesh net or other soccer ball retaining device 44. The tether 42 is adjustable in length. Accordingly, a soccer ball can be suspended at any height or can be positioned on the ground. When positioned on the ground, the tethered ball can be used to practice kicking. By raising the tethered ball above the ground, players can practice kicking the ball on the fly or bicycle kicks. By raising the tethered ball to head level, players can practice striking the ball with their heads.

From FIG. 3, it can also be seen that a supplemental framing structure 50 extends from the inclined target board frame structure 22. The supplemental framing structure 50 defines two netted areas. In the first netted area 52, the netting is tautly strung in the vertical plane. Accordingly, any soccer ball kicked into the first netted area 52 will be rebounded back to the kicker. This enables a player to practice kicking on goal without having to go to the goal to retrieve the kicked soccer ball.

The second netted area 54 defines a small goal with sloped supports and loose netting. The second netted area 54 enables a player to practice kicking on a goal without having the ball bounce away from the gaol.

Both the first netted area 52 and the second netted area 54 have a common height H2, and extend along a predetermined length L. The combined first and second netted areas 52, 54 produces a netted obstacle having a height H2 and length L. This netted obstacle can be used to play soccer tennis, wherein two players pass a soccer ball back and forth over the netted obstacle.

Returning to FIG. 1, it will be understood that in the embodiment of the soccer training apparatus 10 shown, the inclined target board 12 has multiple target apertures 14. A player kicks the soccer ball up a ramp 18 to reach the inclined target board 12. The harder the ball is kicked, the farther the soccer ball flies off the ramp 18. Accordingly, the target apertures 14 at different distances from the ramp 18 can be reached.

Figure 4:
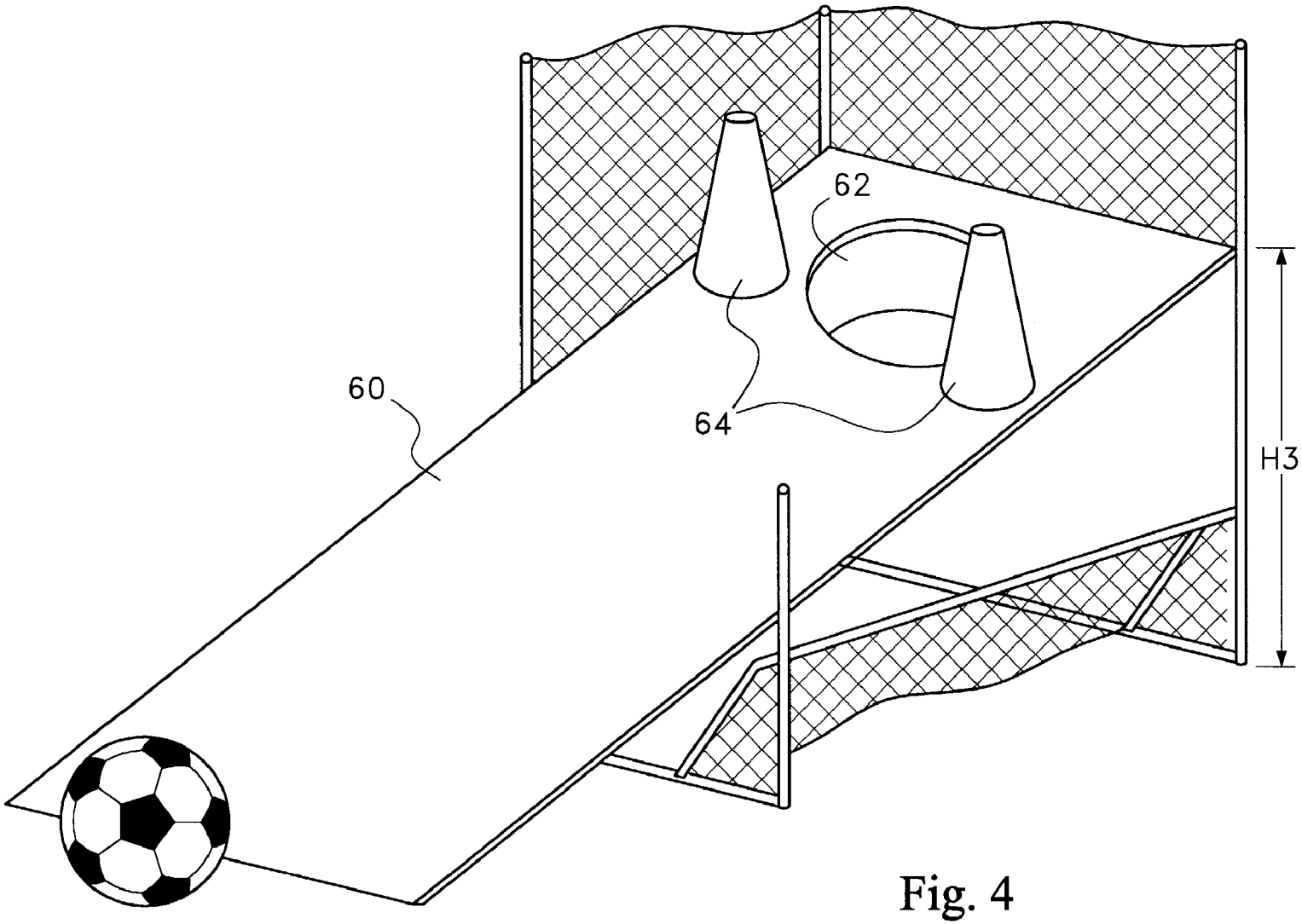
FIG. 4 is a fragmented perspective view of an inclined target board in accordance with the present invention.

An alternate embodiment for the inclined target board is to eliminate the ramp and have a continuous inclined plane that leads from the ground to a target aperture. Referring to FIG. 4, such an embodiment is shown. In FIG. 4, a single inclined plane 60 extends from the ground to a predetermined height H3. A single target aperture 62 is shown on the inclined plane 60, however more than one target aperture can be used. Obstacles 64 are disposed in front of the target aperture 62. The distance between the obstacles 64 can be varied from a distance only slightly wider than a soccer ball to a distance much wider than a soccer ball. As such, a player can develop the ability to precisely kick a soccer ball to a target area. As the abilities of the player increase, the difficulty of reaching the target can be increased by moving the obstacles closer together.

The soccer training apparatus described above has many components. The combination of components is merely exemplary and it should be understood that any of the described components can be eliminated. Furthermore, the orientation of the various components is also exemplary. Different components can be arranged in orientations that differ from what is illustrated. It will also be understood that a person skilled in the art can make alternate embodiments of the present invention using functionally equivalent components that have not been specifically described. All such modifications are intended to be included in the scope of this disclosure as defined by the appended claims.

What is claimed is:

1. An apparatus for teaching soccer related skills, comprising:

an elevated inclined target board having at least one target aperture formed therethrough, wherein said target aperture is sized to enable a soccer ball to pass therethrough;

at least one obstruction disposed on said target board, wherein said obstruction obstructs the movement of a soccer ball;

an inclined plane leading from said elevated inclined target board to the ground; and a first open goal target disposed above a side surface of said target board, said first open goal having the height of a regulation soccer goal, wherein a soccer ball kicked into said first open goal target lands upon said target board.

2. The apparatus according to claim 1, wherein said target board has a top edge and a bottom edge, said top edge being at a first elevation and said bottom edge being at a lower second elevation, and wherein said inclined plane forms a ramp, wherein said inclined plane terminates at an elevation above said second elevation.

3. The apparatus according to claim 1, wherein said inclined plane and said target board lay in a common plane.

4. The apparatus according to claim 1, further including a ball return track disposed below said target board for returning balls that pass through an aperture to a predetermined return point.

5. The apparatus according to claim 1, wherein said target board is disposed within a frame structure.

6. The apparatus according to claim 1, wherein said frame structure defines said first open goal target.

7. The apparatus according to claim 5, wherein said frame structure defines a second open goal target disposed below said side surface of said target board.

8. The apparatus according to claim 5, further including a vertical arm that extends from said frame structure and a tether that extends downwardly from said vertical arm.

9. The apparatus according to claim 8, wherein said tether terminates with an attachment device for attaching a soccer ball to said tether.

10. The apparatus according to claim 5, further including a hoop extending from said frame structure.

11. The apparatus according to claim 10, wherein said frame structure supports an area of taut netting immediately adjacent to said hoop.

12. The apparatus according to claim 5, further including a first goal structure extending from said frame structure, wherein said first goal structure supports a vertical pane of taut netting.

13. The apparatus according to claim 12, further including a second goal structure extending from said first goal structure, wherein said second goal structure supports an area of loose netting.

14. The apparatus according to claim 13, wherein said first goal structure and said second goal structure are aligned and share a common height.

15. The apparatus according to claim 2, wherein said target board has a plurality of target apertures disposed therethrough and said target apertures are linearly aligned.

16. An apparatus for teaching soccer related skills, comprising:

an elevated inclined target board having at least one target aperture formed therethrough, wherein said target aperture is sized to enable a soccer ball to pass therethrough;

at least one obstruction disposed on said target board, wherein said obstruction obstructs the movement of a soccer ball;

an inclined plane leading from said elevated inclined target board to the ground;

a first goal structure extending from said frame structure, wherein said first goal structure supports a vertical pane of taut netting;

a second goal structure extending from said first goal structure, said second goal structure supporting an area of loose netting, wherein said first goal structure and said second goal structure are aligned and share a common height.

17. An apparatus for teaching soccer related skills, comprising:

a frame structure;

an elevated inclined target board supported by said frame structure, said target board having at least one target aperture formed therethrough, wherein said target aperture is sized to enable a soccer ball to pass therethrough;

at least one obstruction disposed on said target board, wherein said obstruction obstructs the movement of a soccer ball;

an inclined plane leading from said elevated inclined target board to the ground;

a vertical arm that extends from said frame structure; and a tether that extends downwardly from said vertical arm wherein said tether terminates with an attachment device for attaching a soccer ball to said tether.

* * * * *